United States Patent [19]

Fink et al.

[11] Patent Number: 4,501,616

[45] Date of Patent: Feb. 26, 1985

[54] LUBRICANT AND MOLD-RELEASE AGENT FOR THE MANUFACTURE OF TIES

[75] Inventors: Hans-Ferdi Fink; Götz Koerner, both of Essen; Rolf Freiberger, Schermbeck-Damm, all of Fed. Rep. of Germany

[73] Assignee: Th. Goldschmidt AG, Essen, Fed. Rep. of Germany

[21] Appl. No.: 162,209

[22] Filed: Jun. 23, 1980

[30] Foreign Application Priority Data

Jun. 26, 1979 [DE] Fed. Rep. of Germany ..... 2925662

[51] Int. Cl.[3] ..... B28B 7/36

[52] U.S. Cl. ..... 106/38.22; 252/52 A

[58] Field of Search ..... 252/52 A; 106/38.22

[56] References Cited

U.S. PATENT DOCUMENTS

| | | | |
|---|---|---|---|
| 3,791,971 | 2/1974 | Lowe | 252/52 A |
| 3,838,052 | 9/1974 | Miller | 252/52 A |
| 4,039,143 | 8/1977 | Brown et al. | 252/52 A |
| 4,263,250 | 4/1981 | Schmidt et al. | 264/338 |

*Primary Examiner*—Lorenzo B. Hayes

*Attorney, Agent, or Firm*—Toren, McGeady and Stanger

[57] ABSTRACT

A lubricant and release agent for the manufacture of tires containing as the active ingredient liquid polyoxypropylenediols or polyoxypropylenepolyoxyethylenediols or ethers of the diols, which liquid has a viscosity of at least 8000 mPa×sec. The use of the release agent of the present invention avoids the occurrence of defects in the interior surface of the vulcanized tire and improves the life of the rubber bags used in the unvulcanized carcass shell of the tire.

9 Claims, No Drawings

LUBRICANT AND MOLD-RELEASE AGENT FOR THE MANUFACTURE OF TIES

BACKGROUND OF THE INVENTION

1. Field of the Invention

The invention relates to a lubricant and release agent for the manufacture of tires. Mcre particularly, the present invention concerns an aqueous dispersion of a lubricant and a release oil used in conjunction with fillers having a leaf-shaped structure and dispersing agents.

2. Description of the Prior Art

In the manufacture of tires, an unvulcanized carcass shell is placed in a metal mold. By blowing up a rubber bag in the interior of the green carcass shell, the tire is pressed against the mold and vulcanized by the action of heat. While being blown up, the expandable rubber bag must slide over the tire carcass. After the vulcanization of the rubber mixture, the rubber bag must be separated from the tire. For this purpose an oily lubricant and release agent is used. This release agent is sometimes referred to as a bag or cold-pressed molding lubricant.

These lubricant and mold release agents generally consist of a silicone oil, a polyalkylene glycol, mica, as a filler, with a leaf-shaped structure and dispersing agents. They may exist in the form of an aqueous or a solvent-containing preparation. Such preparations are described, for example, in German Offenlegungsschrift No. 19 49 618. According to this German Offenlegungsschrift, a mixture is used which consists of 1. 2 to 10 weight percent of liquid dimethylpolysiloxanes with a viscosity of at least 30,000 cSt at 25° C.;
2. 5 to 20 weight percent of ethylene or propylene glycols or copolymers of these compounds with a molecular weight of at least 1000;
3. 25 to 50 weight percent of mica with a particle size of 160 to 600 mesh;
4. 0.5 to 5 weight percent of bentonite clay and a higher polar solvent in an amount which is sufficient for the formation of a gel structure and for the thickening of the mixture;
5. 0.25 to 5 weight percent of lecithin and
6. 25 to 55 weight percent of a hydrocarbon solvent with a boiling point below 200° C.

German Auslegeschrift No. 21 25 948 discloses an aqueous siloxane lubricant for molding tires, which consists of (A) 3 to 40 weight percent of a mixture of
  1. 1 to 20 weight percent of an alkylmethyl siloxane liquid with a viscosity of at least 10,000 cSt at 25° C., based on the weight of the lubricant, and
  2. 2 to 20 weight percent, based on the weight of the lubricant, of a polyalkylene glycol with a molecular weight of at least 1,000, whose alkylene oxide units consist of ethylene oxide, propylene oxide or of combinations of these, or whose alkylene oxide units are copolymerized from ethylene oxide, propylene oxide or of combinations of these with alkylmethylsiloxanes, or (B) 3 to 40 weight percent of a copolymer of an alkylmethylsiloxane and a polyalkylene oxide whose alkylene oxide units consist of ethylene oxide, propylene oxide or of combinations of these, the copolymer (B) having a viscosity of at least 10,000 cSt at 25° C. and containing 5 to 50 weight percent of the alkylmethylsiloxane;

(C) 25 to 50 weight percent of mica with a particle size corresponding to sieves with clear mesh widths of about 0.091 to 0.021 mm;

(D) 0.25 to 5 weight percent of a finely particulate magnesium silicate;

(E) 0.1 to 5 weight percent of lecithin; and (F) 15 to 55 weight percent of water.

Other disclosures showing the state of the art are German Pat. No. 22 25 698, German Offenlegungsschrift No. 24 27 029 and German Offenlegungsschrift No. 22 51 685.

These known compositions do achieve a lubricating and release effect. However, they are not completely satisfactory because up to 5% rejects must be expected even when these materials are used. These rejects may be attributed to the following defects. The silicone oil contained in the preparations may migrate between the overlapping sites of the unvulcanized carcass shell so that, on vulcanization, the overlapping regions do not bond or bond incompletely or defectively to each other. Defective sites, such as, crumbling, may also be observed in the region of the sealing bead of the tires. This defect may be attributed to the same cause. The anhydrous or solvent-free, mica-containing preparation partially flakes away from the inner side of the carcass shell or is transferred to the rubber bag, resulting in defective surfaces on the inner side of the tire or in damage to the rubber bag. It is therefore also a reasonable assumption that only about 250 to 300 tires can be manufactured from one rubber bag.

SUMMARY OF THE INVENTION

We have discovered a lubricant and mold release agent which does not have the aforementioned defects but instead, enables tires to be manufactured with the lowest possible reject rate. At the same time, use of the inventive composition provides a vulcanized tire having a substantially defect-free inner surface and also increases the production life of the rubber bags.

More particularly, the above-noted advantages are achieved in accordance with the present invention by using a mold release agent based on an aqueous dispersion which contains, as an active ingredient, a water insoluble, liquid polyoxypropylenediol or polyoxypropylenepolyoxyethylenediol or ethers thereof with a viscosity of at least 8,000 mPa×sec.

DESCRIPTION OF THE PREFERRED EMBODIMENT

The polyoxypropylenediols, copolymers with polyoxyethylenediols, or their ethers used in the present invention are characterized by three essential properties. They must:

(a) be water insoluble, (b) be liquid, and (c) have a viscosity of at least 8,000 mPa×sec.

These condiditions are fulfilled by polyoxypropylenediols or their ethers with a molecular weight greater than 6,000 which is determined by the hydroxyl number of the corresponding diols or monools. The polyoxypropylenediols may contain oxyethylene units in the form of blocks or the units may be randomly distributed. However, the number of oxyethylene units must be sufficiently low so that the conditions of water insolubility, liquid state, and viscosity are fulfilled. Limits for the oxyethylene content can therefore not be given, because the possible content depends, among other factors, on the molecular weight of the copolymer. Generally, the allowable oxyethylene content increases with increasing molecular weight. Preferred are polyoxypropylenediols or their ethers which do not contain any oxyethylene groups. They may be synthesized, for example, by adding propylene oxide to a monofunctional or multifunctional starter alcohol using a catalyst. Examples of suitable starter alcohols are propanediol, butanediol, hexanediol, glycerin, trimethylolpropane and butanol.

In the concentration in which they are used, the preparations contain 1 to 20 weight percent of release agent, a range of 1 to 4 weight percent being particularly preferred. Dispersing agents are generally used for the preparation of a dispersion. For this purpose, nonionic emulsifiers in particular have proven to be of value. Examples of such emulsifiers are the products of the addition of ethylene oxide to fatty alcohols or fatty acids or alkylphenols, whose alkyl residue contains 6 to 12 carbon atoms. It is appropriate to use 5 to 15 Iweight percent of emulsifiers, based on the diol or its ether which is to be dispersed.

The amount of leaf-shaped filler, particularly, mica, corresponds to the amount normally used in the art. Generally, about 25 to 50 weight percent of the dispersion of such filler is used.

The preparation may also contain conventional thickening agents, for example, bentonite or carboxymethylcellulose, as well as known wetting agents.

By using the inventive lubricating and release agents, the above-mentioned defects which are observed when silicone oil is used in the carcass shell, can be consistantly avoided. At the same time, the lifetime of the rubber bag is increased by 30 percent and more. After drying, the preparations adhere to the inner side of the carcass shell without flaking off and/or without being transferred to the rubber bag.

In the following examples, the preparation of different inventive release compositions is first described and then the composition tested under operating conditions.

EXAMPLE 1

For the preparation of an aqueous lubricating and mold release agent for the manufacture of tires, an emulsion of the inventive polyoxypropylenediol in water is first prepared. For this purpose:

35 weight percent of polyoxypropylenediol,
5 weight percent of emulsifier, and
60 weight percent of water, are emulsified in equipment suitable for the preparation of emulsions.

The polyoxypropylenediol used has a viscosity of 8057 mPa×sec at 25° C. and an OH number of 14 (mg KOH/g). A polyglycol ester of stearic acid, with ca. 80 weight % of oxyethylene groups, is used as the emulsifier.

For producing a ready-to-use preparation, the following are mixed together in a vessel equipped with a stirrer.

46.0 parts by weight of water,
2.0 parts by weight of wetting agent,
2.0 parts by weight of dispersant,
35.0 parts by weight of mica,
0.5 parts by weight of bentonite LT,
14.5 parts by weight of the above-described emulsion.

As a wetting agent, a polyoxyethylene-polyoxypropylene block copolymer with a cloud point of 67° C. is used. The cloud point was determined in a solution of 5 g of the wetting agent in 25 ml of a 25% solution of butyldiglycol in water.

As a dispersing agent, a water-soluble polyacrylate, which is commercially available under the name of Hydropalat 1667, was used. The task of the dispersing agent is to facilitate the dispersion of the mica.

The mica used has a particle size of less than 20 μm.

Bentonite LT is a commercial, aluminum-free magnesium silicate (manufacturer: National Lead Company).

The preparation so produced has a viscosity of 1077 mPa×sec, measured with the "Couette" equipment of Haake-Rotovisko, at a shear gradient of 21.1 $sec^{-1}$. The stability of the preparation was determined by centrifuging at 2,000 rpm. After 30 minutes, less than 5% liquid was observed as the upper layer.

After this mixture was sprayed on the inner side of tire carcass shells, and after the release agent and lubricant film had dried, the tires were vulcanized on a Bag-o-matic machine.

Defect-free tires were obtained. The release and lubricating properties were exellent, so that the lifetime of the rubber bag was considerably increased. With this mixture, 400 tires were prepared without any defects.

EXAMPLE 2

The inventive preparation was produced as described in Example 1.

The polyoxypropylenediol has a viscosity of 18300 mPa×sec at 25° C. and an OH number of 12 (mg KOH/g).

A preparation produced with this polyoxypropylenediol has a viscosity of 1214 mPa×sec, measured with the "Couette" equipment of Haake-Rotovisko at a shear gradient of 21.1 $sec^{-1}$. The centrifuge stability, measured at 2000 rpm, is excellent. After 30 minutes, less than 4% liquid was observed as the upper layer.

With this lubricant and release agent, several hundred tires were produced on a Bag-o-matic machine. The rubber bag was readily removed from the tires and all the tires produced were defect-free.

A rubber mixture, intended for the interior side of passenger car tires, was coated with a thin layer of the preparation, dried and then molded against an untreated rubber disk and vulcanized. After the vulcanized panel was removed, only a slight transfer of lubricant and release agent layer to the untreated rubber disk could be detected. This result illustrates the good adhesion of the formulation to the inner layer.

EXAMPLE 3—COMPARISON EXAMPLE (not in accordance with the present invention)

The preparation was produced as described in Example 1. However, the polyoxypropylenediol, which was used, has a viscosity of only 5030 mPa×sec at 25° C. and an OH number of 22.4 (mg KOH/g). It therefore falls outside the limits claimed.

A preparation, produced with this polyoxypropylenediol, has a viscosity of 927 mPa×sec, measured with the "Couette" equipment of Haake-Rotovisko at a shear gradient of 21.1 $sec^{-1}$. The centrifuge stability, measured at 2,000 rpm, is excellent. After 30 minutes, less than 5% clear liquid was observed as the upper layer.

With this mixture, tires were produced on a Bag-o-matic machine. It was significantly more difficult to remove the rubber bag from the tires than when the preparations of Examples 1 and 2 were used.

In order to evaluate the adhesion of this preparation to the inner layer, the experiment described in Example 2 was carried out. After vulcanizing and removing the cured panel, considerable quantities of the lubricant release agent layer had transferred to the untreated rubber disk.

The lubricant and release agent of this comparison example is therefore not suitable for use in the manufacture of tires.

What is claimed is:

1. A lubricant and release agent composition for use in the manufacture of tires consisting essentially of a lubricating and release effective amount of a water insoluble liquid selected from the group consisting of polyoxypropylenediols, and ethers of said diols, said liquid having a viscosity of at least about 8,000 mPa×sec., wherein the amount of liquid is from about 1 to 20 weight percent based on the weight of the composition.

2. A lubricant and release agent composition for use in the manufacture of tires consisting essentially of a lubricating and release effective amount of a water insoluble liquid selected from the group consisting of polyoxypropylenediols, polyoxypropylenepolyoxyethylenediols, and ethers of said diols, said liquid having a viscosity of at least about 8,000 mPa×sec, fillers having a laminar structure, and dispersing agents.

3. The composition of claim 1 or 2 wherein the amount of liquid is from about 1 to 4 weight percent based on the weight of the composition.

4. The composition of claim 2 wherein the dispersing agent is a non-ionic emulsifier.

5. The composition of claim 4 wherein the amount of emulsifier is from about 5 to 15 weight percent based on the diol or ether to be dispersed.

6. The composition of claim 1 or 2 wherein the ethers of said diols are formed from a monofunctional or multifunctional starter alcohol.

7. The composition of claim 1 or 2 wherein the ethers of said diols are formed from a starter alcohol selected from the group consisting of propanediol, butanediol, hexanediol, glycerin, trimethylolpropane and butanol.

8. The compositions of claim 1 or 2 wherein the liquid has a molecular weight of more than about 6000 as determined by the hydroxyl number.

9. The composition of claim 1 or 2 wherein the liquid is a polyoxypropylenediol or ether thereof which does not contain any oxyethylene groups.

* * * * *

UNITED STATES PATENT AND TRADEMARK OFFICE

CERTIFICATE OF CORRECTION

PATENT NO. : 4,501,616

DATED : February 26, 1985

INVENTOR(S) : Hans-Ferdi Fink, et al

It is certified that error appears in the above-identified patent and that said Letters Patent is hereby corrected as shown below:

In the heading of the Patent and column 1, lines 2-3, should read as follows:

-- [54] LUBRICANT AND MOLD-RELEASE AGENT FOR THE MANUFACTURE OF TIRES --.

Signed and Sealed this

*Nineteenth* Day of *November 1985*

[SEAL]

*Attest:*

DONALD J. QUIGG

*Attesting Officer*

*Commissioner of Patents and Trademarks*